US005276998A

United States Patent [19]

Joen et al.

[11] Patent Number: 5,276,998

[45] Date of Patent: Jan. 11, 1994

[54] METHOD AND APPARATUS FOR WASHING AND CLEANING A WORKPIECE

[76] Inventors: Anton P. Joen, 24323 Buchanan Ct., Suite 1959, Farmington Hills, Mich. 48335; Dennis A. Sevakis, 1716 Bellwood Ct., Bloomfield Hills, Mich. 48302

[21] Appl. No.: 895,992

[22] Filed: Jun. 8, 1992

[51] Int. Cl.[5] ..... B24B 31/06

[52] U.S. Cl. ..... 51/7; 51/316; 51/17

[58] Field of Search ..... 51/17, 7, 317, 316, 315, 163.1, 313

[56] References Cited

U.S. PATENT DOCUMENTS

| | | | |
|---|---|---|---|
| 2,660,835 | 12/1953 | Burden | 51/7 |
| 3,192,677 | 7/1965 | Johnson et al. | 51/321 |
| 3,197,340 | 7/1965 | Bellinger | 134/28 |
| 3,546,821 | 2/1968 | Strom | 51/163 |
| 3,581,440 | 6/1971 | McKinney et al. | 51/7 |
| 3,584,419 | 6/1971 | Hulet | 51/317 |
| 3,877,178 | 4/1975 | Campenelli | 51/163 |
| 4,164,103 | 8/1979 | Hesse et al. | 51/417 |
| 4,174,591 | 11/1979 | Dupre et al. | 51/16 |
| 4,203,257 | 5/1980 | Jamison et al. | 51/2 |
| 4,280,304 | 7/1981 | Kobayashi | 51/315 |
| 4,326,362 | 4/1982 | Williams et al. | 51/417 |
| 4,387,537 | 6/1983 | Roach et al. | 51/17 |
| 4,408,417 | 10/1983 | Kobayashi et al. | 51/163 |
| 4,460,479 | 7/1984 | Mulder | 252/79.4 |
| 4,716,684 | 1/1988 | Roach | 51/7 |
| 4,803,811 | 2/1989 | Birkle et al. | 51/7 |
| 4,829,714 | 5/1989 | Crouch et al. | 51/17 |
| 4,937,981 | 7/1990 | Temme | 51/7 |
| 4,991,360 | 2/1991 | DeSpain | 51/317 |
| 5,088,238 | 2/1992 | Lin | 51/163.1 |

FOREIGN PATENT DOCUMENTS

| | | | |
|---|---|---|---|
| 0876389 | 10/1981 | U.S.S.R. | 51/163.1 |
| 963826 | 10/1982 | U.S.S.R. . | |
| 1292992 | 2/1987 | U.S.S.R. | 51/163.1 |
| 2019272 | 10/1979 | United Kingdom | 51/7 |

*Primary Examiner*—Robert A. Rose

*Attorney, Agent, or Firm*—Gifford, Groh, Sprinkle, Patmore and Anderson

[57] ABSTRACT

A washing and cleaning machine and method of cleaning to debur and completely remove all types of contaminants such as oil and grease. The workpieces to be cleaned are loaded into a fixture chamber, and the chamber is filled with an abrasive cleaning media such as steel pins. The workpieces are directly vibrated through fixturing in the confined media as working fluid continuously flows through the fixture chamber, removing contaminants.

19 Claims, 6 Drawing Sheets

METHOD AND APPARATUS FOR WASHING AND CLEANING A WORKPIECE

BACKGROUND OF THE INVENTION

1. Field of the Invention

This invention relates to a method and apparatus for washing and cleaning workpieces. More particularly, this invention pertains to a method and apparatus for washing and cleaning metal castings and machined parts to remove all types of contaminants such as rust, oils, stains, paints or other coatings, chips, burrs, particles and oxides to meet stringent part cleanliness specifications.

2. State of the Prior Art

The machines and methods for cleaning or washing articles or parts are extremely diverse, and even in the field of metal workpieces, primarily in the form of castings, forgings, extrusions and machined parts, such multiform processes and equipment pervades the various industries.

High pressure streams of abradant and liquids are commonly used separately or in combinations. Shot blasting or sand blasting with various types of abrasive particles typifies a dry abradant process; whereas, steam cleaning or high pressure jet impingement is representative of high pressure liquid cleaning.

Other processes and equipment rely on circulation of abradant and liquids such as in the use fluidized beds of abrasive particles or in submerged solvent washers.

Most often, multi-stage processing is required to meet even minimum industry standards, and in space age and intricately machined automotive valve and engine block components, sequential cleaning has been a virtual necessity.

Multi-stage equipment utilizing combinations of various types of machines are still in common use; for example, using barrel-finishing, wire brushing, buffing and solvent immersion. A recently developed process utilizes an intermittent operating conveyor with workpieces being serially conveyed to sequential grinding or deburring stations in which rotary reciprocating tools engage the workpiece followed by gyro-finishing apparatus in which the workpieces are chucked and rotated while being submerged in an abrasive media.

Various batch-type equipment have been developed combining solid abrasive particles with cleaning fluid. Typically, smaller workpieces are tumbled in drums and larger workpieces are subjected to jet blasts with a high velocity liquid carrying an abrasive grit, the liquid often being tailored to include an appropriate solvent or surfactant.

In other batch equipment, larger and smaller parts can be processed where the abrasive media and liquid is vibrated or subjected to a turbulent flow such as by the use of centrifugal force while the part or parts are immersed in the media-liquid.

In still another batch type of operation, the parts are vibrated while the abrasive media and liquid are cascaded through a working chamber. A primary problem with this latter type of equipment and some of the other equipment where the media-liquid is vibrated is that the chamber and other equipment parts along with any fixturing is subjected to the abrasive action of the media so as to be a major maintenance-equipment replacement problem.

SUMMARY OF THE INVENTION

The present invention is directed to a new method and eguipment for washing cleaning workpieces in a batch-type operation which substantially reduces or eliminates the problems attendant in the prior art devices and in which the cycle time is greatly reduced, being in some cases less than 20% of prior art time cycles. The quantity of abrasive media is also greatly reduced over prior art devices, and most importantly, the present inventions provides a method and equipment for cleaning workpieces in a single stage while meeting stringent part cleanliness specifications. Prior to the present invention, multi-stage washing and cleaning was necessary to meet the cleanliness millipore inspection standards of various engine and valve manufactures, requiring at least a solvent or surfactant type washing step following the use of an abrasive media.

The new method of washing and cleaning a workpiece according to the invention includes, in a preferred embodiment, the following steps;

a) The workpiece is mounted in the fixture chamber.

b) The fixture chamber is closed.

c) The fixture chamber is vibrated at a relatively low frequency.

d) An alkali-based working fluid is caused to flow through the fixture chamber while it is being vibrated at a relatively low frequency. Such an alkali-based working fluid is preferably a sodium hydroxide base working fluid.

e) The fixture chamber is filled with a cleaning media. The cleaning media preferably is in the form of metal pins having a size selected for the passages and holes to be cleaned within the workpiece.

f) When the chamber is filled, the flow of cleaning media is stopped.

g) The fixture chamber is then vibrated at a relatively high frequency while the flow of alkali-based working fluid continues into and through the chamber continuously removing contaminants including metal being removed from the part.

h) After a given cycle time determined to complete the cleaning of the part, the chamber is then vibrated at a relatively low frequency which can be the same as the original filling frequency.

i) The media is then dumped from the fixture chamber while the working fluid is flowing and the fixture chamber is being vibrated at the low frequency.

j) In-flow of working fluid and low frequency vibration is continued for a period of time after the media has been dumped to assure complete discharge of the media and contaminants from the workpiece. The flow of working fluid can be increased over the flow rate used during the working cycle to assist the flush of contaminants.

k) The vibration and flow or working fluid is then stopped.

l) Finally the workpiece is removed from the fixture chamber.

Modifications of the foregoing preferred method of operation are made in embodiments where the fixture chamber is separated from the cleaning machine for mounting of the workpiece and filling the chamber with media prior to the working cycle, is mounted in the cleaning machine for the working cycle, and is removed from the machine for dumping of the media and removal of the clean part.

The new machine for performing the washing and cleaning process includes a fixture chamber which has its walls lined with a plastic shield. This shield is preferably a ultra-high molecular weight, UHMW, plastic which eliminates abrasion of the chamber and fixture parts. A front access door provides access through which the workpiece is introduced for mounting to the wall of the chamber. A bottom door is supplied for dumping the cleaning media when it is in an open position and for retaining the cleaning media within the chamber when the bottom door is in its closed position. Fluid outlet means are provided preferably in this bottom door for allowing flow of the working fluid and cleaning debris through the chamber during the working cycle when the bottom door is closed.

In a preferred embodiment of the machine, an inlet is specifically designed at the top of the fixture chamber for admitting the cleaning media and the working fluid to the chamber but preventing the out flow of the cleaning media during the vibration of the chamber while flow of working fluid is maintained through the chamber. This prevents the cleaning media from spilling over and abrading other working parts such as hydraulic cylinders, pump components and the like. In a preferred embodiment of the machine, the working fluid is recycled through the fixture chamber by passing it through a first filter for removing relatively large contaminant particles and then through a second filter for removing relatively small contaminant particles before it is returned to the fixture chamber.

BRIEF DESCRIPTION OF THE DRAWING

The advantages of the present invention will be more apparent from the following detailed description when considered in connection with the accompanying drawing wherein.

DETAILED DESCRIPTION OF THE PREFERRED EMBODIMENTS OF THE INVENTION

Figure 1:
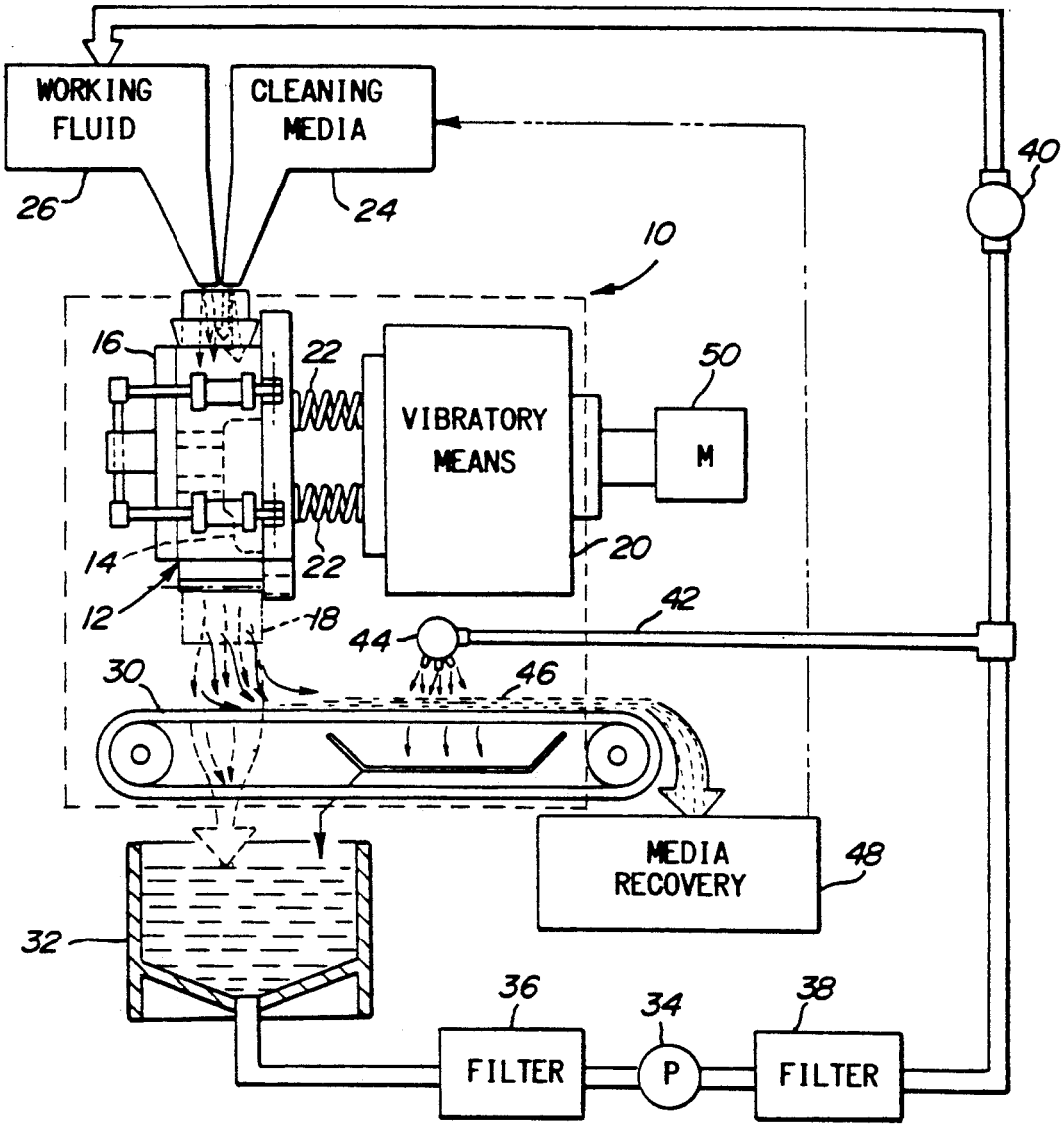
FIG. 1 is a schematic view of the washing and cleaning machine according to the invention showing the flow of cleaning media and working fluid through the fixture chamber with reclamation of the media and fluid in closed circuits.

Referring to FIG. 1, the washing and cleaning machine 10 according to the invention includes a fixture chamber 12 in which a workpiece or workpieces 14 are mounted through front access door 16. With bottom media dump door 18 closed and the fixture chamber 12 being vibrated by vibrator 20 through vibration transmitting springs 22, cleaning media from metering device 24 is introduced to the top of the chamber.

The cleaning media can take several forms of abrasive particles of either a ceramic based material or metal. The particular material used and the size or geometric configuration of the particles are chosen for the particular workpiece and the amount of deburring necessary in the overall cleaning process. In a preferred embodiment of the invention hardened steel or stainless steel pins are used. A double pointed pin having a 1/16" diameter by 9/32" long has proven to be a very good working media.

The flow of working fluid through inlet 26 is also started at the same time as the media is being added, primarily to increase lubricity so that all of the cavities in the workpiece will be filled with the cleaning media. Conventional water soluble machining coolant mixtures or detergents have been used with the abrasive media in prior cleaning machines. It has been discovered that an alkaline based fluid is much more effective. In a preferred form of the invention, a commercially available product called "COME CLEAN" provides an excellent working fluid. The product is available from Castrol Industrial Great Lakes Incorporated of Howell, Mich., and it is a sodium hydroxide based industrial cleaner that has excellent grease and oil removal characteristics. The use of such a working fluid has made it possible to have the cleaned work pieces meet stringent millipore cleanliness specifications.

When the fixture chamber 12 has been filled with cleaning media, the flow of media is stopped, but the flow of working fluid is continued through the working cycle and dump cycle of the machine. The working fluid flows out of the bottom of the working chamber preferably through holes 28; see FIG. 4. The working fluid flows through the media conveyor 30 into a collection sump 32. Working fluid is caused to flow from the sump 32 by a pump 34 through a first filter 36 which removes larger contaminant particles such as metal chips and the like and then through a finer filter 38 returning through a valve 40 to fluid inlet 26. It will be appreciated that various types of filters can be used and their location can be changed, but it is important that a second filter be used in order to remove very small particles. This second filter along with the choice of an alkaline based working fluid contributes to the completeness of the cleaning cycle which allows the workpieces to meet stringent cleanliness standards without additional rinsing or degreasing. The first filter 36 may take the form of a vacuum filter in a settling tank. Typically a conveyor is intermittently operated to convey a filter paper through the settling tank to carry chips and other contaminant materials out of the tank as liquid is drawn through the paper and conveyor into a clean liquid chamber. There may be an intermediate pump (not shown) between the collection sump 32 and the settling tank (not shown) with pump 34 then withdrawing the liquid from the clean liquid chamber or an additional storage tank for delivery through the second filter 38. The second filter 38 may be a cartridge type filter capable of removing micron sized particles. Clean working fluid is also introduced through line 42 and distribution nozzle pipe 44 to clean the media 46 as it travels from its exit point from fixture chamber 12 to a media recovery system 48 at the end of conveyor 30. The media recovery system 48 can include a conventional elevator type conveyor to return the washed media to the cleaning media inlet 24.

Vibrator 20 is driven by motor 50 and can be regulated to adjust the working frequency and a lower filling frequency. A working cycle frequency of approximately 30 hertz has been found to be optimum with a lower frequency of 5–10 hertz to be used while the cleaning media is being introduced into the fixture chamber 12.

Figure 3:
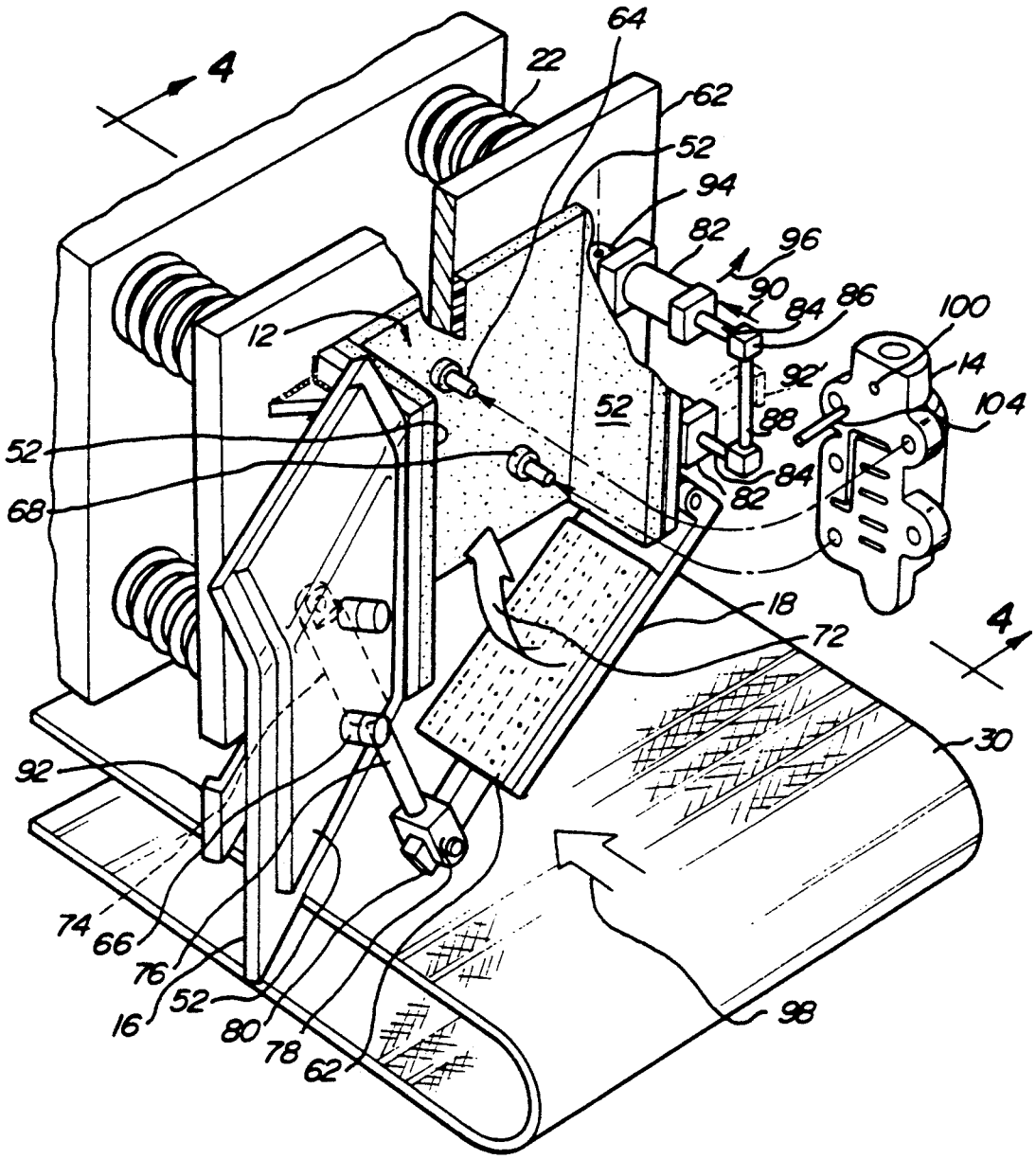
FIG. 3 is an enlarged perspective view of the front end of the machine showing the operation of the front access door and a bottom dumping door along with an exploded presentation of a workpiece showing how it is assembled to the fixturing devices of the chamber. This figure also shows how the workpiece is directly vibrated through vibration transmitting springs, a mounting platen which serves as the back wall of the fixture chamber as well as showing the location of a conveyor for transporting the cleaning media.
Figure 4:
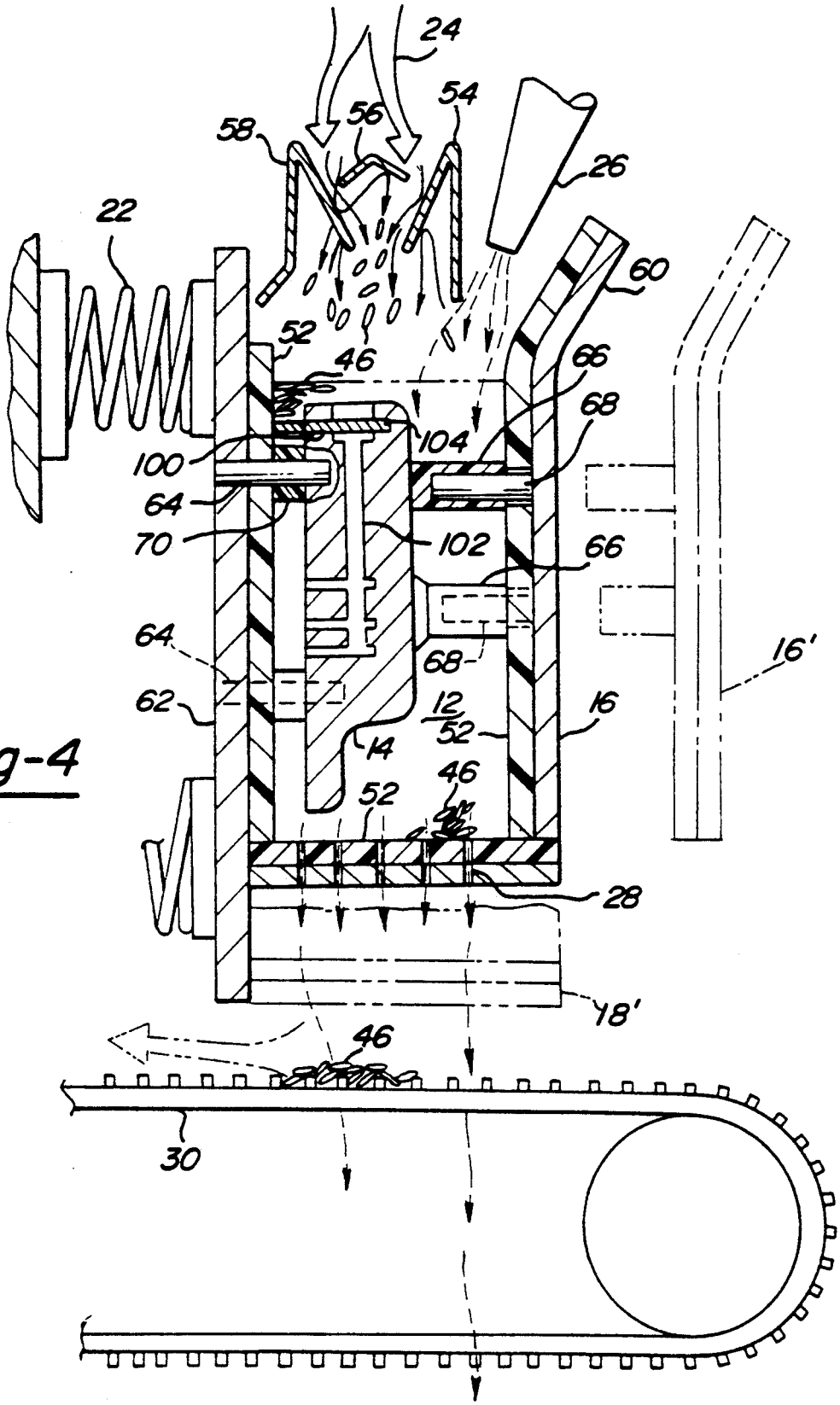
FIG. 4 is a side elevational view, partially in section taken along line 4—4 of FIG. 3 showing how the workpiece has been firmly anchored through the front and back wall of the fixture chamber and how the cleaning media and working fluid is introduced into the fixture box with the media being retained by the bottom door but allowing the working fluid to flow through the chamber when the bottom door is in its closed positioned.

As can best be seen in FIGS. 3 and 4, the fixture chamber 12 is lined with plastic shields 52. These shields are preferably lined with an ultra high molecular weight, UHMW, plastic such as UHMW polyethylene. This material has a greater toughness, abrasion resistance and freedom from stress-cracking than conventional polyethylene, but still retains polyethylene's good chemical resistance and lubricity.

Media inlet 26 is configured with baffles 54, 56 and 58 to allow the cleaning media 46 to be introduced into the chamber, but prevents media from vibrating out of the top of the fixture chamber during the working cycle and prevents erosion of cleaning machine parts. The top of front access door 16 is tapered at 60 work in conjunction with working fluid inlet 26 to prevent media escape at this point.

The workpiece 14 is mounted to the vibrating platen 62 which also serves as the rear fixture chamber wall by fixture pins 64 which project into bores in the workpiece. The front access door has a number of pressure pads 66 mounted on pins 68 so that as the access door is moved from its opened position shown in phantom at 16' to its closed position as shown, the pressure pads bear against the workpiece to firmly anchor the workpiece to the platen 62. The pressure pads 66 are made from the same UHMW material as the shields 52, and likewise, the fixture pins are protected by shield spacers 70 of the same material.

As best seen in FIG. 3, the bottom media dump door 18 is moved between its open position shown and its closed position in a direction of arrow 72 by cylinder 74 through its piston rod 76 and clevis connection 78 to closing bar 80. The front access door 16 is firmly locked in its closed position by the use of locking cylinders 82 working through their piston rods 84, connections 86 and lock bar 88 as it moves inwardly in the direction of arrow 90 trapping keeper lock latch 92 as shown in phantom at 92'. Cylinders 82 are hinged as shown at 94 in order to swing outwardly, as shown by arrow 96, to receive the latch member 92 when the lock bar 88 is in its outward position.

Figure 2:
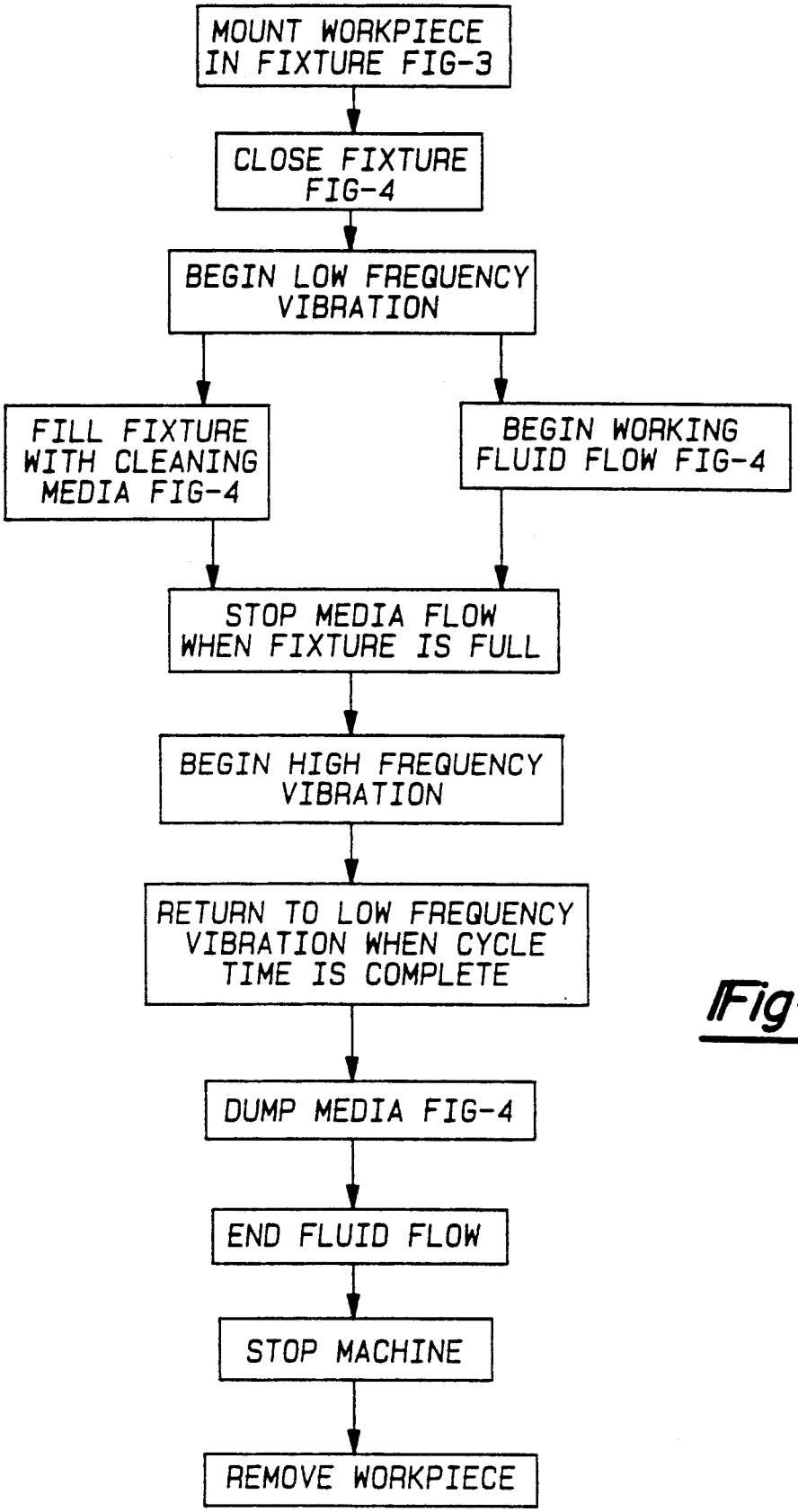
FIG. 2 is a flow diagram of a preferred method of operating the cleaning machine of FIG. 1.

A preferred method of operating the cleaning machine 10 of FIGS. 1, 3 and 4 is shown in the flow chart of FIG. 2. With the front access door 16 in its open position, the workpiece 14 is mounted on fixture pins 64 which extend into bores in the workpiece as shown by the exploded view of the workpiece in FIG. 3. The fixture chamber is closed with the bottom media dump door 18 being moved in the direction of arrow 72 through bottom door cylinder 74. The dump door 18 is shown in its open position in FIG. 3 and its closed position in FIG. 4, with the open position in FIG. 4 being shown in phantom at 18'. With the lock bar 88 in its fully outward position obtained by actuation of cylinders 82, the lock bar 88 is swung outwardly in a direction of arrow 96 so that as the front access door 16 is swung to its closed position, the keeper latch 92 extends inside and past the lock bar 88 as shown at 92' in FIG. 3. The cylinders 82 are then actuated to move the lock bar 88 in a direction of arrow 90 fully locking the access door 16 and exerting pressure on the workpiece 14 through pressure pads 66. Vibrator 20 is actuated through motor 50 to vibrate fixture chamber 12 at a low frequency of the order of 5 to 10 hertz. The fixture chamber 12 is then filled with cleaning media 46 through media metering inlet 24 moving between the baffles 54, 56 and 58 as shown in FIG. 4. At the same time working fluid is admitted through fluid inlet 26 and continues to flow through the working chamber out of holes 28 in the bottom media dump door 18. When the fixture chamber 12 has been filled with media as shown in FIG. 4, the flow of media is stopped and the vibrator 20 is vibrated at a working frequency of approximately 30 hertz. The cleaning cycle can vary depending upon the particular workpiece being cleaned. The valve bodies shown as the workpiece 14 is FIGS. 1, 3 and 4 typically required a cycle time of at least eight minutes with prior art media and working fluid flow through equipment. The cycle in the cleaning machine 10 is approximately 1½ minutes which is less than 20% of prior machines, greatly enhancing the through put of the machine.

When the washing and cleaning cycle has been finished, the vibrator 20 is returned to a low frequency vibration of approximately 5–10 hertz. With the working fluid still flowing, the bottom media dump door 18 is opened by actuation of cylinder 74 to dump the media onto conveyor 30 which moves the media in the direction of arrow 98 in FIG. 3 rearwardly to the media recovery system 48. Preferably the flow of working fluid is increased over the flow during the working cycle to fully flush all of the media and contaminants out of the passages in the workpiece and to clean the chamber and fixtures. This flow is continued after the media has been dumped for a short period of time to assure complete flushing. The flow of working fluid is then discontinued and the vibrator 20 turned off and the access door 16 can be moved to its open position and the workpiece can be removed.

Referring to FIGS. 3 and 4, it has been found that when a small "pin" hole, such as pin hole 100, intersects with a larger valve spool bore, such as bore 102, that metal can be rolled over in the cleaning process so that the pin hole 100 will not accept a roll pin that is used to retain the valve spool in its bore. In order to eliminate such roll over, a properly sized fixture pin 104 is inserted in the pin hole 100 to completely eliminate such roll over.

Figure 5:
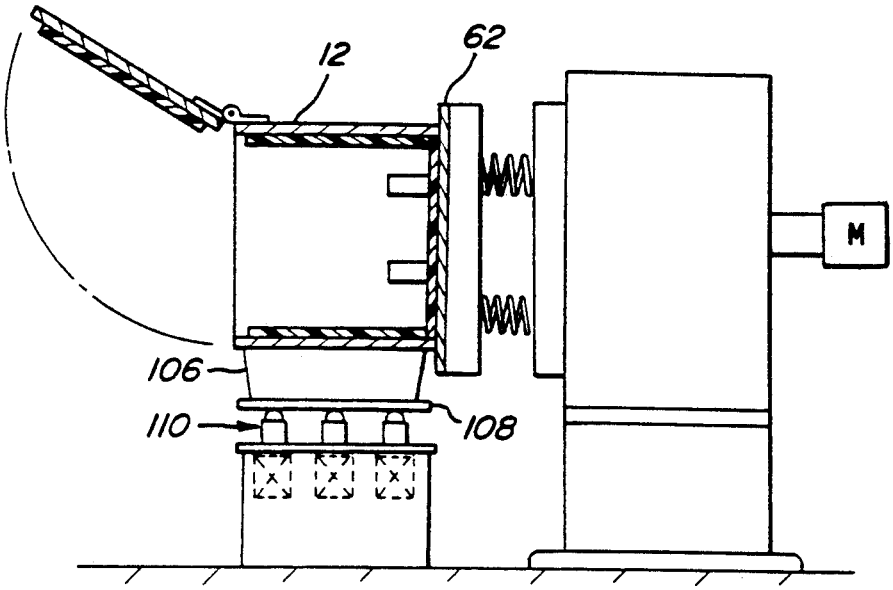
FIG. 5 is an elevational view partially in section of another embodiment of the invention showing support of the fixture chamber by roller bearings.
Figure 6:
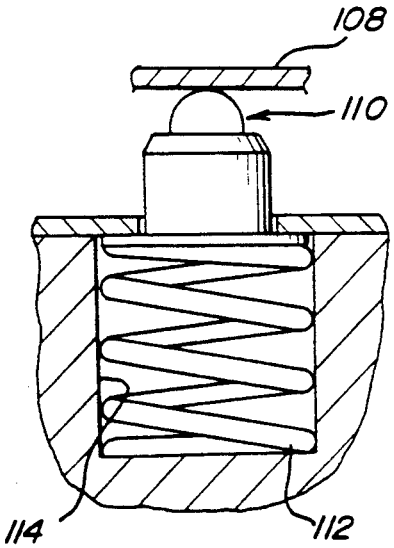
FIG. 6 is an enlarged fragmentary elevational view partially in section showing the details of the roller bearing mount of the fixture chamber of FIG. 5 showing the spring loading which allows vertical as well as horizontal displacement during vibration of the fixture chambers.

As can be seen in FIGS. 1, 3 and 4, the fixture chamber 12 is supported in a cantilever fashion from platen or rear chamber wall 62. With large workpieces, this imposes considerable load on the machine. In the embodiment shown in FIGS. 5 and 6, the fixture chamber 12 is supported through framework 106 and support plate 108 on ball bearings 110. Vertical movement is provided by springs 112 in working cavities 114. This greatly increases the total weight of workpieces that can be cleaned.

Figure 7:
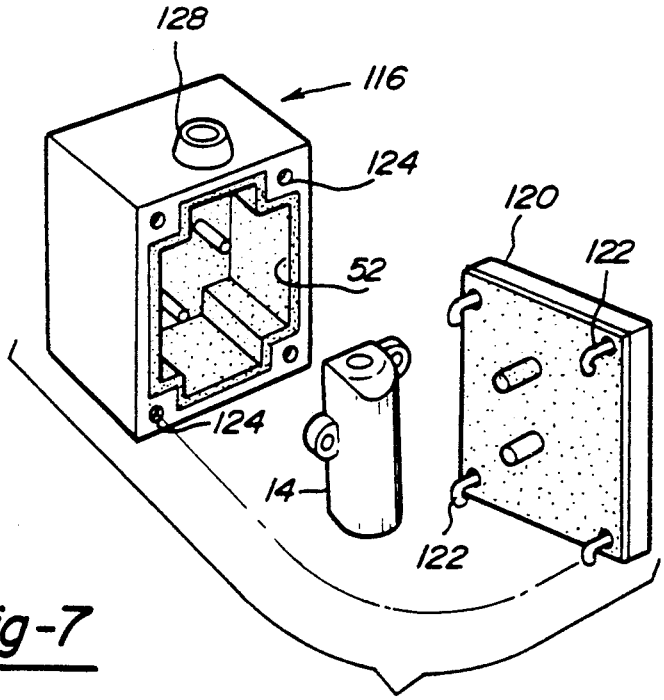
FIG. 7 is an exploded perspective view of another embodiment of a fixture chamber in which the workpiece is introduced through a removable front door and the media is loaded within the chamber before attachment of the chamber to the cleaning machine.
Figure 8:
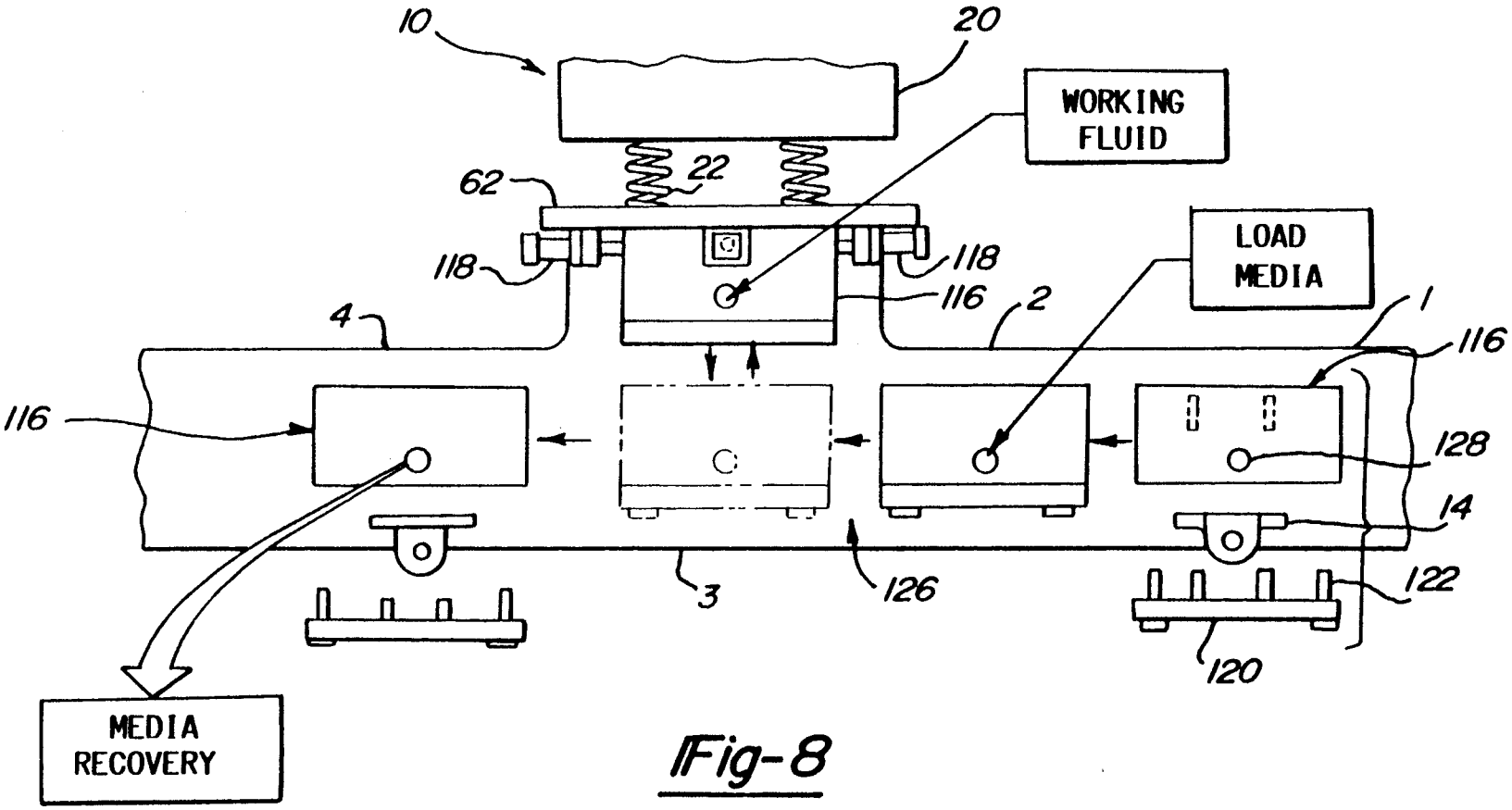
FIG. 8 is a schematic plan view of another embodiment of the invention utilizing the fixture box of FIG. 7 showing the sequential introduction of the workpiece to the fixture box, the loading of cleaning media, the attachment of the fixture box to the cleaning machine for the working cycle, and the removal of the workpiece and media after the fixture box has been released from the cleaning machine.

In another embodiment of the invention as shown in FIGS. 7 and 8, the fixture chamber 116 is removably mounted on the machine platen 62 with lock pin mechanisms 118 so that it can be removed for mounting and removal of the workpiece and also for filling and dumping the cleaning media. As best seen in FIG. 7, the front access door 120 is removable from the fixture chamber 116 for loading of the workpiece 14. The front access door 120 is attached to fixture chamber 116 by twisting lock pins 122 in receiving cavities 124.

As best seen if FIG. 8, the conveyor 126 moves the fixture chamber 116 through successive work stations 1, 2, 3 and 4. At work station 1, the workpiece 14 is loaded into the fixture chamber 116 and the front access door 120 is locked to the chamber. At work station 2, the media is loaded through opening boss 128. At work station 3, the fixture chamber is moved off of the conveyor and attached to the cleaning machine 10 by lock pins 118. At work station 4, the access door 120 is removed so that the workpiece can be removed and the media recovered from the fixture chamber. This mode of operation increases the through put of the machine by handling the workpiece and media fill and dump apart from the machine.

As compared to a cleaning machine in which the media is continuously cascaded through the fixture chamber during the cleaning cycle, many advantages and improvements are apparent. As previously mentioned, the cycle time to completely clean the workpiece including deburring, is greatly reduced, in many cases to less than 20% of the previous cycle time requirements. The wear or erosion of the fixture chamber and associated mechanisms as well as the fixturing has been reduced by confining the media within the fixture chamber during the working cycle and by covering the entire interior of the fixture chamber, including the fixture elements, with a UHMW plastic. The workpieces processed in the washing and cleaning machine 10 pass stringent millipore cleanliness inspection standards without the need for a separate wash cycle. The amount of media required is considerably reduced in the closed cycle providing a great economy and also allowing the media to be changed to another media where required with a minimum of effort. Where a continuous flow of media is used, the media recovery system including an elevator type conveyor is subject to considerably more erosion and consequent maintenance. When the fixture chamber is supported by a roller mechanism, the stress and consequent maintenance is greatly reduced, and the total weight of the workpiece being cleaned can be increased.

The embodiments of the invention in which an exclusive property or privilege is claimed are defined as follows:

1. A method of washing and cleaning a workpiece comprising the following steps:

a) mounting the workpiece in a fixture chamber;
b) closing the fixture chamber;
c) filling the fixture chamber with a cleaning media;
d) flowing working fluid into the fixture chamber;
e) vibrating the fixture chamber;
f) discontinuing the flow of working fluid;
g) discontinuing vibration of the fixture chamber;
h) opening the fixture chamber;
i) dumping the media from the fixture chamber; and
j) removing the workpiece from the fixture chamber.

2. The method according to claim 1 wherein the fixture chamber is vibrated at a relatively low frequency according to step e) as the fixture chamber is being filled with cleaning media according to step c) and while working fluid is flowing according to step d).

3. The method according to claim 2 wherein when the fixture chamber is full of media by the filling step c), media flow into the chamber is stopped and the fixture chamber is vibrated at a relatively high frequency according to step e).

4. The method according to claim 3 wherein working fluid is allowed to flow through the fixture chamber according to step d) and the flow is discontinued according to step f) when the media has been dumped according to step i).

5. The method according to claim 4 wherein when a cycle time has been completed during which the fixture chamber has been vibrated according to step e) at the relatively high frequency, the frequency is reduced to a relatively low frequency as the media is being dumped in step i).

6. The method according to claim 5 wherein a bottom chamber door to the fixture chamber is opened according to step h) when the cycle time has been completed and the media is dumped through the open bottom door according to step i).

7. The method according to claim 6 wherein a front access door to the fixture chamber is opened according to step h) when the media has been dumped according to step i) so that the workpiece can be removed according to step j).

8. The method according to claim 1 wherein the fixture chamber is filled with cleaning media according to step c) before the flow of working fluid is commenced according to step d).

9. The method according to claim 8 wherein steps a) through j) are sequentially performed.

10. The method according to claim 9 wherein the fixture chamber is removable from a cleaning machine so that steps a), b) and c) are performed while the fixture chamber is separated from the cleaning machine, steps d), e), f) and g) are performed while the fixture chamber is attached to the machine and steps i) and j) are performed after removal of the fixture chamber from the machine.

11. The method according to claim 1 wherein the media introduced in step c) are metal pins.

12. The method according to claim 1 wherein the working fluid used in step d) has an alkali base.

13. The method according to claim 12 wherein the working fluid used in step d) has a sodium hydroxide base.

14. The method according to claim 1 wherein the working fluid in step d) flows through the fixture chamber, through a first filter to remove larger contaminant particles, through a second filter to remove smaller contaminant particles and is returned for flow through the fixture chamber.

15. The method according to claim 1 wherein the workpiece being cleaned has intersecting cross holes and in a step before step b) a rod is inserted into one of said holes to prevent metal roll over.

16. A method of washing and cleaning a workpiece comprising the following steps:

a) mounting the workpiece in a fixture chamber;
b) closing the fixture chamber;
c) vibrating the fixture chamber at a relatively low frequency;
d) flowing an alkaline base working fluid through said fixture chamber;
e) filling the fixture chamber with the cleaning media;
f) stopping the flow of cleaning media when the fixture chamber is full;
g) vibrating the fixture chamber at a relatively high frequency;
h) vibrating the fixture chamber at a relatively low frequency after a given cycle time has been completed;
i) dumping the media from said fixture chamber during step d) and h);
j) continuing working fluid flow and low frequency vibration under steps d) and i) after the media has been dumped during step j);
k) stopping vibration and flow of working fluid;
l) removing the workpiece from the fixture chamber.

17. A machine for washing and cleaning workpieces comprising in combination:

a fixture chamber having walls lined with a plastic shield, said chamber having a front access door through which workpieces can be introduced for mounting to a wall of said chamber, a bottom door for dumping cleaning media when the bottom door is in an open position each of said front access door and said bottom door being hinged to a side wall of said fixture chamber, with said front access door having an edge surface which seals against an edge surface of said bottom door, to thereby form an inside corner seam of said fixture chamber when said front access door and said bottom door are in a closed position and retaining said cleaning media within said chamber when the bottom door is in a closed position, means for vibrating said chamber to circulate said cleaning medium in a closed circuit within said chamber when said bottom door is in a closed position; and fluid outlet means for allowing flow of a working fluid through said chamber when said bottom door is closed.

18. The machine according to claim 17 including inlet means at the top of said fixture chamber for admitting cleaning media and working fluid to said chamber but preventing outflow of cleaning media during vibration of said chamber and while working fluid is being admitted to flow through said chamber.

19. The machine according to claim 17 wherein said circulating means includes means for recirculating working fluid from said fixture chamber through a first filter for removing relatively large contaminant particles, a second filter for removing relatively small contaminant particles and means returning said working fluid from said second filter to said fixture chamber.

* * * * *